US008057976B2

(12) United States Patent
Ueda et al.

(10) Patent No.: US 8,057,976 B2
(45) Date of Patent: Nov. 15, 2011

(54) METHOD FOR PRODUCING TONER

(75) Inventors: Tomoaki Ueda, Tokyo (JP); Masanori Abe, Tokyo (JP)

(73) Assignee: Empire Technology Development LLC, Wilmington, DE (US)

( * ) Notice: Subject to any disclaimer, the term of this patent is extended or adjusted under 35 U.S.C. 154(b) by 161 days.

(21) Appl. No.: 12/544,839

(22) Filed: Aug. 20, 2009

(65) Prior Publication Data

US 2010/0047707 A1 Feb. 25, 2010

(30) Foreign Application Priority Data

Aug. 21, 2008 (WO) ..... PCT/JP2008/064937
Aug. 14, 2009 (JP) ..... 2009-188110

(51) Int. Cl.
*G03G 9/083* (2006.01)

(52) U.S. Cl. ..... 430/106.2; 430/106.1; 430/124.3; 430/124.4; 430/137.1

(58) Field of Classification Search ..... 430/108.6, 430/106.2, 106.1, 106.3, 137.1, 124.3, 124.4; 399/335
See application file for complete search history.

(56) References Cited

U.S. PATENT DOCUMENTS

| | | | | |
|---|---|---|---|---|
| 4,482,239 | A | 11/1984 | Hosono et al. | |
| 6,465,145 | B1 * | 10/2002 | Yamauchi | 430/108.23 |
| 2004/0253181 | A1 * | 12/2004 | Port et al. | 424/9.3 |
| 2006/0172216 | A1 * | 8/2006 | Goto | 430/109.3 |
| 2007/0072104 | A1 | 3/2007 | Yabe et al. | |
| 2007/0231614 | A1 | 10/2007 | Kondo et al. | |
| 2008/0160440 | A1 * | 7/2008 | Nishikawa | 430/108.6 |

FOREIGN PATENT DOCUMENTS

| | | |
|---|---|---|
| JP | 54-054639 | 5/1979 |
| JP | 57-177159 | 10/1982 |
| JP | 58-220164 | 12/1983 |
| JP | 01-134385 | 5/1989 |
| JP | 06-231957 | 8/1994 |
| JP | 07-320916 | 12/1995 |
| JP | 08-176212 | 7/1996 |
| JP | 2002-099112 | 4/2002 |
| JP | 2004-287153 | 10/2004 |
| JP | 2005-010596 | 1/2005 |
| JP | 2006-301305 | 11/2006 |
| JP | 2006-307126 | 11/2006 |

(Continued)

OTHER PUBLICATIONS

Kirtk-Othmer Encyclopedia of Chemical Technology, fourth edition, vol. 10, John Wiley & Sons, NY (1993), pp. 381-383.*

(Continued)

*Primary Examiner* — Janis L Dote
(74) *Attorney, Agent, or Firm* — Foley & Lardner LLP

(57) ABSTRACT

A toner which can efficiently induce high-frequency magnetic induction heating by Neel relaxation and/or Brown relaxation is provided. A toner including a core particle containing a thermoplastic polymer material and superparamagnetic ferrite fine particles having a particle diameter of less than 100 nm which adhere to the surfaces of the core particle is manufactured by directly forming the superparamagnetic ferrite fine particles having a particle diameter of less than 100 nm on the surfaces of the core particle so that the superparamagnetic ferrite fine particles having a particle diameter of less than 100 nm are not in contact with each other. As a result, the toner is prevented from being scattered due to the influence of a magnetic field, so that a high quality image is formed.

19 Claims, 2 Drawing Sheets

FOREIGN PATENT DOCUMENTS

| | | |
|---|---|---|
| JP | 2007-094202 | 4/2007 |
| JP | 2007-277080 | 10/2007 |

OTHER PUBLICATIONS

American Chemical Society (ACS) on STN File Registry No. 12230-58-9, which was entered in STN on Nov. 16, 1984.*

Abe, M., "Ferrite-Film Formation from an Aqueous Solution, and its Applications," *Journal of the Magnetics Society of Japan*, vol. 22, No. 9, 1998, pp. 1225-1232 (English abstract only).

Abe, M., "Ferrite plating: a chemical method preparing oxide magnetic films at 24-100° C., and its applications," *Electrochimica Acta*, vol. 45, No. 20, 2000, pp. 3337-3343.

Abe, M. et al., "Preparation and Application of Magnetic Films by Ferrite Plating in Aqueous Solution," *Mat. Res. Soc. Symp. Proc.*, vol. 232, 1991, pp. 107-117.

Abe, M. et al., "Ultrasound Enhanced Ferrite Plating; Bringing Breakthrough in Ferrite Coating Synthesized from Aqueous Solution," *IEEE Transactions on Magnetics*, vol. 33, No. 5, 1997, pp. 3649-3651.

Ishikawa, K. et al., "New Magnetic Capsule Toner and Carrier with High Imaging-Quality and Low Fusing Temperature Prepared by Ferrite Plating," Dig. Intermag. Conf., Kyoto (1987) EB-04.

Nagahata, S. et al., "Ferrite-Coated Polymer Microspheres Prepared by Ferrite Plating for Immunoassay," *The Japan Society of Powder and Powder Metallurgy*, 1992, pp. 279-282.

Rosensweig, R.E., "Heating magnetic fluid with alternating magnetic field," *Journal of Magnetism and Magnetic Materials*, vol. 252, 2002, pp. 370-374.

Zhang, M. et al., "Ferrite Plating on Porous Silica Microspheres for Ultrasonic Contrast Agents," *IEEE Transactions on Magnetics*, vol. 30, No. 6, 1994, pp. 4692-4694.

Notice of Reasons for Rejection for JP 2009-188110 mailed Jul. 27, 2010 (with English translation).

* cited by examiner

METHOD FOR PRODUCING TONER

TECHNICAL FIELD

The present invention relates to a method for manufacturing a toner which is used for an image forming method, such as an electrophotographic image forming method, in which an unfixed toner image is formed on a recording medium and is then fixed thereon.

In particular, the present invention relates to a toner suitably used for an image forming method in which an unfixed toner image is fixed in a non-contact manner using high-frequency magnetic induction heating and to a method for manufacturing the toner.

BACKGROUND ART

In an image forming apparatus, such as a dry electrophotographic image forming apparatus, an unfixed toner image is formed on a recording medium, and subsequently this toner image is fixed thereon to form an image. In the image forming apparatus as described above, as means for fixing an unfixed toner image which adheres to a recording medium, in general, a device has been used in which a recording medium carrying an unfixed toner image thereon is allowed to pass between a heating roller and a pressure roller so as to fix a toner on the recording medium by heat and pressure.

However, according to the fixing means described above, electrical power consumption used to maintain the heating roller at a toner fixable temperature is high, and on the other hand, when the heating roller is placed in a stand-by state at a lower temperature in order to save the electrical power, the time required for the start-up disadvantageously increases. In addition, since the recording medium is supplied between the heating roller and the pressure roller, paper jam may also disadvantageously occur.

In order to overcome the problems described above, a fixing method to melt-fix a toner itself in a non-contact manner using induction heating has been proposed in which a toner containing metal particles and/or magnetic particles which generates heat by high-frequency magnetic induction is used, and in which a recording medium carrying an unfixed toner image thereon is allowed to pass in a high-frequency magnetic field (Patent document 1).

According to the method described above, as the heat generation mechanism, either: a heat generation phenomenon is used in which when a high-frequency magnetic field is applied to a toner containing fine metal particles, heat is generated by eddy-current losses caused by eddy currents flowing in the fine metal particles; or a heat generation phenomenon is used in which when a high-frequency magnetic field is applied to a toner containing ferromagnetic fine particles, heat is generated by hysteresis losses caused by magnetic hysteresis characteristics of the ferromagnetic fine particles.

However, in the case in which a toner containing magnetic particles is used in the method described above, when an unfixed toner image passes under a magnetic field, toner particles are scattered by the influence of magnetic flux lines, and as a result, a problem in that an image is distorted may arise in some cases.

In addition, in a high-frequency magnetic induction heating method using the eddy-current losses or the hysteresis losses described above, in order to generate heat required to melt-fix a toner, magnetic particles contained in the toner must have a relatively large particle diameter (approximately one micrometer to several tens of micrometers).

That is, in an eddy-current loss method, since the eddy-current loss P is proportional to the square of the product of a fine metal particle diameter d, an excitation frequency f, and a magnetic flux density B, in order to ensure the current loss P required to melt-fix a toner, the particle diameter d must be increased to a certain extent. In addition, in a hysteresis loss method, as the particle diameter of ferromagnetic fine particles is decreased, a loop area of the magnetic hysteresis decreases. When the particle diameter is decreased to less than 100 nm, the magnetic hysteresis characteristics totally disappear, and the fine particles have superparamagnetic characteristics. Accordingly, heating cannot be performed by the magnetic hysteresis loss, and hence, the particle diameter cannot be decreased.

Accordingly, in a toner using these fine metal particles, since the metal strongly absorbs visible light, the transparency of the toner is degraded, and hence a problem in that the toner can only be used to form a monochromatic image may also arise.

Through intensive research carried out by the inventors of the present invention on the behavior of magnetic particles under the influence of a magnetic filed, it was discovered that magnetic particles are scattered because the magnetic particles are magnetized by a high-frequency magnetic field applied thereto from the outside, and therefore: magnetic particles adjacent in a magnetic flux line direction are attracted and/or aggregated to each other; or magnetic particles present in a direction perpendicular to the magnetic flux line direction are repelled to each other, so that positions of the magnetic particles are considerably changed. Furthermore, since the magnetic force generated by magnetization is inversely proportional to the square of the distance between particles, once the aggregation thereof starts, an avalanche phenomenon occurs, and as a result, the aggregation occurs over the entire region to which a magnetic field is applied.

Incidentally, the intensity of magnetic force generated by magnetization approximately depends on the mass of a magnetic particle. Hence, when magnetic particles having a high heat-generation efficiency (quantity of heat generated per unit mass of a magnetic substance) are used, and the amount of magnetic particles contained in a toner can be decreased, the above magnetic force acting on each toner particle containing the magnetic particles can be decreased, and hence it is believed that scattering of toner can be prevented.

Accordingly, alternative magnetic particles having a high heat-generation efficiency which generate heat by high-frequency magnetic induction were investigated, and it was found that heat-generation phenomena based on Neel relaxation and Brown relaxation observed in superparamagnetic fine particles having a particle diameter of less than 100 nm have a significantly high heat-generation efficiency, and that superparamagnetic fine particles having a particle diameter of less than 100 nm are suitably used as heat-generation magnetic particles for a heat fixing toner.

In recent researches on the characteristics of superparamagnetic fine particles having a particle diameter of less than 100 nm, a heat-generation phenomenon based on the principle called Brown relaxation and/or Neel relaxation has been observed under high-frequency magnetic field excitation. Brown relaxation is a relaxation phenomenon which occurs in such a way that when a high-frequency magnetic field is applied to superparamagnetic particles, the particles themselves mechanically rotate in order to conform their magnetization direction to the change between the positive and negative directions of the high-frequency magnetic field. Since the rotation described above cannot follow the change of high-frequency magnetic field due to the friction between the particles and a liquid, hysteresis of the magnetic field versus the magnetization is generated, so that heat is generated. This is the heat-generation caused by Brown relaxation. On the other hand, Neel relaxation occurs in such a way that when a high-frequency magnetic field is applied to superparamagnetic particles, the magnetization direction rotates in order to conform their magnetization direction to the change between the positive and negative directions of the high-frequency magnetic field. Since the superparamagnetic particles have a small particle volume, their magnetization produce a heat fluctuation, thus cannot follow the change of high-frequency magnetic field. As a result, the hysteresis is generated, thereby causing a heat generation. In addition, heat generation caused by a so-called hysteresis loss is an exothermic phenomenon caused by a hysteresis itself which is generated when a high-frequency magnetic field is applied to a magnetic substance having a multi-magnetic domain structure.

In addition, through a research carried out by the inventors of the present invention on the relationship between a particle diameter d and a heat release value P, it was found that in superparamagnetic ferrite fine particles having a particle diameter of 18 to 23 nm, heat generation caused by Neel relaxation is particularly significant, and a superior heat-generation efficiency can be obtained as compared to that of superparamagnetic ferrite fine particles having a different particle diameter.

Based on the findings described above, the inventors of the present invention carried out high-frequency magnetic induction heating by Neel relaxation and/or brown relaxation using a compound which contains superparamagnetic fine particles having a particle diameter of less than 100 nm as a toner, and as a result, it was found that in an image forming method in which an unfixed toner image is melt-fixed in a non-contact manner by high-frequency magnetic induction heating, the toner particles are not scattered, and a non-distorted high quality image can be formed.

PRIOR ART DOCUMENT

Patent Document

Patent Document 1: Japanese Unexamined Patent Application Publication No. 1-134385

SUMMARY OF THE INVENTION

Problems to be Solved by the Invention

However, it was found that among toners in which the contents of superparamagnetic fine particles having a particle diameter of less than 100 nm are equal to each other, high-frequency magnetic induction heating by Neel relaxation and/or Brown relaxation is likely to occur in some toners and is not likely to occur in other toners.

Accordingly, an object of the present invention is to provide a toner which can efficiently induce high-frequency magnetic induction heating by Neel relaxation and/or Brown relaxation.

Means for Solving the Problems

Through intensive and detailed research carried out by the inventors of the present invention on high-frequency magnetic induction heating of a toner which contains superparamagnetic fine particles having a particle diameter of less than 100 nm, it was found that even if a primary particle diameter of superparamagnetic fine particles added to a toner is less than 100 nm, when the superparamagnetic fine particles aggregate in the toner and have an aggregated particle diameter of 100 nm or more, Neel relaxation and/or Brown relaxation does not occur. Accordingly, it was found that when the toner is composed of a core particle and superparamagnetic fine particles having a particle diameter of less than 100 nm which adhere to the surface of the core particle, and the superparamagnetic fine particles having a particle diameter of less than 100 nm are separated from each other, for example, when superparamagnetic fine particles having a particle diameter of less than 100 nm adhere to the surface of the core particle containing a thermoplastic polymeric material, aggregation and integration among the superparamagnetic fine particles having a particle diameter of less than 100 nm are not likely to occur, and the heat-generation efficiency by Neel relaxation and/or Brown relaxation can be enhanced.

In addition, the inventors of the present invention discovered that a toner having the structure described above can be manufactured by directly forming superparamagnetic ferrite fine particles having a particle diameter of less than 100 nm on surfaces of core particles, and as a result, the present invention was made.

That is, one aspect of the present invention is as follows.

A method for manufacturing a toner to be fixed by high-frequency magnetic induction heating which includes at least a core particle containing a thermoplastic polymer material and superparamagnetic ferrite fine particles having a particle diameter of less than 100 nm which adhere to the surfaces of the core particle. The method described above comprises: preparing a core particle dispersion in which the core particle containing a thermoplastic polymer material is dispersed; introducing divalent iron ions ($Fe^{2+}$) to the core particle dispersion; introducing an oxidizing agent to the core particle dispersion in the presence of water; and stopping the growth of ferrite on the surface of the core particle after a predetermined time has elapsed from the introduction of the oxidizing agent.

In addition, another aspect of the present invention is as follows.

A toner to be fixed by high-frequency magnetic induction heating comprising: core particle containing a thermoplastic polymer material; and superparamagnetic fine particles having a particle diameter of less than 100 nm which adhere to the surface of the core particle.

Effect of the Invention

Since the toner of the present invention has the structure in which superparamagnetic ferrite fine particles having a particle diameter of less than 100 nm adhere to the surface of each core particle so as not to be in contact with each other, Neel relaxation and/or Brown relaxation occurs in most or all of the superparamagnetic ferrite fine particles having a particle diameter of less than 100 nm, and hence high-frequency magnetic induction heating can be efficiently performed.

Hence, according to the present invention, in an image forming method, such as an electrophotographic image forming method, in which an unfixed toner image is formed on a recording medium, and in which the toner image is fixed in a non-contact manner using high-frequency magnetic induction heating, a high quality image can be formed at a low power consumption. Accordingly, in one embodiment, a method for forming an image includes forming an unfixed toner image on a recording medium; and fixing the unfixed toner image on the recording medium by using a high-frequency magnetic field.

Furthermore, according to the present invention, since the size of magnetic particles contained in a heat fixing toner is very small, the transparency of toner particles is improved, and a color image having a high resolution and a high saturation can also be formed as well as a monochromatic image.

BEST MODE FOR CARRYING OUT THE INVENTION

First, a toner of the present invention will be described.

A toner manufactured by a manufacturing method of the present invention at least includes core particles containing a thermoplastic polymer material and superparamagnetic fine particles having a particle diameter of less than 100 nm which adhere to the surfaces of the core particles.

Figure 1:
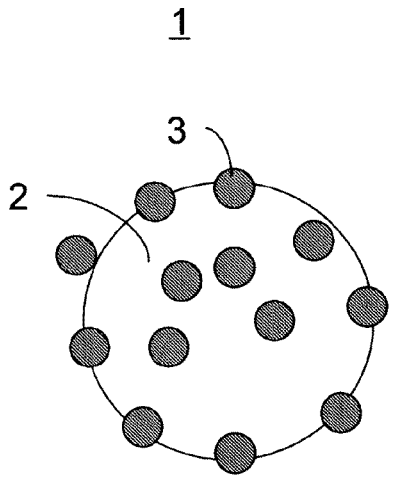
FIG. 1 is a model illustration showing the structure of a toner of the present invention.

In FIG. 1, a model illustration of a toner 1 of the present invention is shown. Superparamagnetic fine particles 3 adhere to the surface of each core particle 2 so as to be separated from each other.

In the present invention, the core particles are not particularly limited as long as containing a thermoplastic polymer material. As the thermoplastic polymer material, a material may be used which is melt-fixed on a recording medium by heating using Neel relaxation and/or Brown relaxation. In particular, various binder resins which have been used for toners may be used, and the binder resins include, for example, polyacrylate, polystyrene, styrene copolymer, such as styrene-butadiene copolymer or styrene-(meth)acrylic acid ester copolymer, and polyester; however, the binder resins are not limited thereto.

As long as the object of the present invention is not impaired, conventionally known additives for toner, such as a wax and an antistatic agent, may be added to the core particles.

In the toner of the present invention, since the particle diameter of the superparamagnetic fine particles used for induction heating is very small, unlike toners used for a related high-frequency magnetic induction heating system in which eddy current losses and/or hysteresis losses are used, the transparency of the toner is not so much degraded by the magnetic particles used for induction heating. Hence, in particular, the toner of the present invention is suitably used to form a color image. Accordingly, in the present invention, a coloring agent may also be added to the core particles. As the coloring agent, known organic or inorganic coloring agents (such as pigment and dye) may be used.

The size of the core particles is not particularly limited. In general, as the particle diameter of core particles is decreased, a toner can be melt-fixed in a shorter period of time by induction heating; however, on the other hand, the handling properties and influence on the health of human beings must also be taken into consideration. From the points as described above, the particle diameter of the core particles may be set in the range of 1 to 20 μm and may also be set in the range of 5 to 10 μm.

In the present invention, the superparamagnetic fine particles having a particle diameter of less than 100 nm are not particularly limited as long as having a particle diameter of less than 100 nm and exhibiting superparamagnetism. For example, as a material forming the superparamagnetic fine particles, a ferromagnetic material may be used, and particular examples include ferrites having a spinel structure, such as magnetite, maghemite, and Co ferrite; and ferrites having a hexagonal structure, such as barium ferrite.

In addition, in the present invention, the particle diameter is a biaxial average diameter, that is, an average diameter of the minor axis and the major axis. The minor axis and the major axis, as used herein, refer to the short side and the long side, respectively, of a rectangle with a minimum area circumscribed to one superparamagnetic fine particle.

In order to induce Neel relaxation and/or Brown relaxation, the particle diameter of the superparamagnetic fine particles which adhere to the surfaces of the core particles must be less than 100 nm. In the present invention, in consideration of heating efficiency, with respect to the number of all the superparamagnetic fine particles which adhere to the core particles, the ratio of the number of superparamagnetic fine particles having a particle diameter of less than 100 nm may be 80% or more and may also be 90% or more.

In superparamagnetic ferrite fine particles, the particle diameter thereof correlates with the heat release value by Neel relaxation and/or Brown relaxation, and it has been known that when the particle diameter of the superparamagnetic fine particles is 30 nm or less, particularly in the range of 18 to 23 nm, the heat-generation efficiency is maximized. Hence, the particle diameter of the superparamagnetic fine particles may be set in the range described above. In this case, the ratio of the number of superparamagnetic fine particles having a particle diameter of 30 nm or less with respect to the number of all the superparamagnetic fine particles which adhere to the core particles may be 80% or more or may also be 90% or more. In addition, the ratio of the number of superparamagnetic fine particles having a particle diameter in the range of 18 to 23 nm with respect to the number of all the superparamagnetic fine particles which adhere to the core particles may be 80% or more or may also be 90% or more.

In melt-fixing an unfixed toner image, when a large amount of toner is adhered to a recording medium (for example, when solid printing is performed), the temperature of the recording medium (recording paper) is increased by relaxation heat generated from the toner by induction heating, and hence, there is a fear that ignition may occur in some cases. However, according to the present invention, since superparamagnetic fine particles having a high heat-generation efficiency are used as the magnetic particles for a heat fixing toner, the problem described above has been already solved. The reasons for this are as follows. Here, the Curie point of a superparamagnetic substance is the value defined for a bulk sample having the same composition as that of the superparamagnetic fine particles.

Since the magnetic susceptibility decreases at the Curie point or above, even under a high-frequency magnetic field, Neel relaxation and/or Brown relaxation does not occur. Hence, when the temperature of a superparamagnetic substance is increased by high-frequency magnetic induction heating to the Curie point, further heating does not occur.

In the present invention, by: using the feature of high-frequency magnetic induction heating as described above; and by determining the composition of superparamagnetic fine particles having a particle diameter of less than 100 nm formed on surfaces of core particles so that the Curie point defined for the bulk sample having the same composition as that of the superparamagnetic fine particles is lower than a temperature at which a recording medium is ignited, ignition of the recording medium caused by overheating in fixing can be prevented.

In addition, the above Curie point must be a fixing temperature or above, that is, in other words, the above Curie point must be not lower than a temperature at which the toner (core particles) is melt-fixed.

From the points described above, the Curie point of the superparamagnetic fine particles having a particle diameter of less than 100 nm which are formed on the surfaces of the core particles varies in accordance with the types of recording media and core particles, and the content of the superparamagnetic particles in the toner, it may be in the range of 100 to 300° C. and may also be in the range of 100 to 200° C.

In the toner of the present invention, a plurality of superparamagnetic fine particles having a particle diameter of less than 100 nm adheres to the surface of each core particle.

The number and the mass of the superparamagnetic fine particles having a particle diameter of less than 100 nm which adhere to one core particle are not limited and are appropriately determined in accordance with the composition and the particle diameter of the superparamagnetic fine particles, the type of thermoplastic polymer material, the type of fixing means, and the like.

Since the toner of the present invention is used in an image forming method which uses Neel relaxation and/or Brown relaxation as a high-frequency magnetic induction heating mechanism, the heat-generation efficiency of a magnetic substance is high as compared to that of a conventional system using an eddy current loss and/or a hysteresis loss. Hence, in the toner of the present invention, the content of the magnetic particles contained in the toner can be decreased. In particular, the content of the superparamagnetic fine particles having a particle diameter of less than 100 nm may be 10 to 100 parts by mass with respect to 100 parts by mass of the thermoplastic polymer material contained in the core particles and may be 10 to 50 parts by mass or 20 to 30 parts by mass.

According to the toner of the present invention, since the content of the magnetic particles contained in the toner can be decreased as described above, a magnetic force generated by magnetization of each magnetic particle, which acts on each toner particle, can be decreased, and hence when an unfixed toner image is placed under a magnetic field, scattering of the toner caused by the influence of the magnetic lines can be prevented.

According to the toner of the present invention, the superparamagnetic fine particles having a particle diameter of less than 100 nm which adhere to the surface of each core particle are not in contact with each other. Here, "being not in contact with each other" means that the ratio of the number of the superparamagnetic fine particles having a particle diameter of less than 100 nm which are not in contact with each other to the number of all the superparamagnetic fine particles having a particle diameter of less than 100 nm which adhere to the surface of each core particle is 80% or more. The ratio of the number of the particles which are not in contact with each other may be 85% or more or 90% or more.

Next, a method for manufacturing the toner of the present invention will be described. The method for manufacturing the toner of the present invention is not particularly limited, and for example, the superparamagnetic fine particles may be adhered to the surfaces of the core particles after the core particles and the superparamagnetic fine particles having a particle diameter of less than 100 nm are separately prepared, or the superparamagnetic fine particles may be formed on the surfaces of the core particles.

Hereinafter, as one example of the method for manufacturing the toner of the present invention, a method for forming superparamagnetic ferrite fine particles on the surfaces of the core particles using a so-called ferrite plating method or another solution process method will be described.

In this method, first, divalent iron ions $Fe^{2+}$ are introduced into a dispersion in which the core particles are dispersed in a dispersion medium so that the ions are adsorbed to the surfaces of the core particles. In particular, for example, an aqueous dispersion in which the core particles are dispersed in water is added to an aqueous solution containing divalent iron ions $Fe^{2+}$, or an aqueous solution containing divalent iron ions $Fe^{2+}$ is added to an aqueous dispersion in which the core particles are dispersed in water, so that these ions are adsorbed to the surface of the core particles.

Next, an oxidizing agent is added to the core particle dispersion in the presence of water (in the above particular example, an oxidizing agent is added to the obtained mixed reaction solution) to partially oxide $Fe^{2+}$ to $Fe^{3+}$ and carry out hydrolysis of $Fe^{3+}$, to form ferrite having a spinel structure on the surfaces of the core particles. Since OH groups are present on the surface of the ferrite thus generated, $Fe^{2+}$ is further adsorbed to the OH groups, and the oxidation of $Fe^{2+}$ and the hydrolysis of $Fe^{3+}$ are sequentially repeated, so that the ferrite grows.

When ferrite particles grow to a desired size, the growth reaction of ferrite is stopped, so that core particles provided with ferrite fine particles having a desired particle diameter on the surfaces thereof can be obtained. That is, ferrite fine particles are formed on the surfaces of the core particles at an initial stage of ferrite plating, but when the plating time is further increased, a continuous film is formed; hence, when plating is performed for an appropriately short period of time, a ferrite covering composed of ferrite fine particles is formed on the surface of each core particle.

In the method of the present invention, the type of dispersion medium is not particularly limited, and for example, an aqueous medium, such as water, or an organic solvent having a high solubility to water, such as ethanol may be used.

The temperature and pH of the reaction solution are not particularly limited. In order to promote the adsorption of $Fe^{2+}$ to the core particles, the oxidation of $Fe^{2+}$, and the hydrolysis of $Fe^{3+}$, the temperature of the reaction solution may be from 60 to 100° C. In addition, from the same point of view as described above, a buffer solution such as an ammonium acetate solution may be added to the reaction solution so as to obtain a pH of 6 to 11.

In addition, the concentration of the core particles is not particularly limited, and for example, the number of the core particles per one liter may in the range of from $10^{15}$ to $10^{18}$.

A method for introducing $Fe^{2+}$ to the core particle dispersion is not particularly limited, and for example, a solution containing $Fe^{2+}$ ($FeCl_2$ solution or the like) may be added.

$Fe^{2+}$ introduced into the core particle dispersion is adsorbed via a coordinate bond to hydrophilic groups, such as an OH group and a COOH group, present on the surfaces of the core particles. In order to promote the adsorption of $Fe^{2+}$ and the like to the core particles, hydrophilic groups may be introduced to the surfaces of the core particles by a known method.

The amount of $Fe^{2+}$ to be introduced is not particularly limited, and for example, the concentration may be in the range of 1 to 100 mmol/liter.

Besides $Fe^{2+}$, when desired, other metal ions may be introduced to the dispersion so as to adjust the composition of ferrite formed on the surfaces of the core particles. The other metal ions to be added upon when desired are not particularly limited, and example, metal ions, such as $Mn^{2+}$ $Co^{2+}$, $Ni^{2+}$, $Cu^{2+}$, and $Zn^{2+}$, generally contained in ferrite may be used. These metal ions are adsorbed to the surfaces of the core particles together with $Fe^{2+}$ or to the surfaces of ferrite layers, and when ferrite are formed and grown by the hydrolysis of $Fe^{3+}$, these metals are incorporated in the ferrite.

The oxidizing agent which is added to the core particle dispersion to oxidize $Fe^{2+}$ to $Fe^{3+}$ is not particularly limited, and for example, nitrite ions ($NO_2^-$), nitrate ions ($NO_3^-$), and air ($O_2$) may be used.

The oxidizing agent is introduced in the presence of water. Water may be added in advance to the dispersion or may be added to the dispersion simultaneously with the introduction of the oxidizing agent. The concentration of the oxidizing agent is not particularly limited, and for example, it may be in the range of 50 to 1,000 ml/liter.

In general, a ferrite plating method is used to form a covering layer made of ferrite; however, in the present invention, the growth of ferrite is stopped after a predetermined time has elapsed from the introduction of the oxidizing agent, that is, when ferrite grows into fine particles having a desired particle diameter of less than 100 nm. Accordingly, the structure can be realized in which superparamagnetic fine particles adhere to the surface of each core particle without being in contact with each other.

That is, in a general ferrite plating method, first, ferrite nuclei are formed on each core particle surface, and adjacent ferrite nuclei coalesces with each other as the growth proceeds, so that a continuous film is finally formed; however, in the present invention, since the growth of ferrite is intentionally stopped before the film is formed, ferrite fine particles are formed on the surface of each core particle.

The predetermined time, that is, the time necessary for ferrite to grow into fine particles having a predetermined particle diameter of less than 100 nm from the introduction of the oxidizing agent, considerably varies depending on the temperature, pH, core particle concentration, $Fe^{2+}$ concentration of the dispersion, and the like; however, the predetermined time may be determined in advance by repeatedly carrying out experiments in advance. According to one example, the predetermined time is approximately several minutes to several tens of minutes.

A method for stopping the growth of ferrite on the surfaces of the core particles is not particularly limited, and for example, the pH and/or temperature of the core particle dispersion may be adjusted so as to disturb the adsorption of $Fe^{2+}$ and the like to the core particles, the oxidation of $Fe^{2+}$, and the hydrolysis of $Fe^{3+}$, or the core particles may be separated from the dispersion medium.

When the predetermined time is decreased so as to stop ferrite plating at the initial stage, a covering composed of fine particles is obtained; however, the number of the fine particles formed on the surface of each core particle is preferably as large as possible so far as the fine particles does not coalesce with each other. The optimum predetermined time decreases under plating conditions in which the growth rate of fine particles is high (that is, the case in which the concentration of the supply source of $Fe^{2+}$ and/or the oxidizing agent is high).

However, when the concentration of the core particles to be supplied is increased, the amount of $Fe^{2+}$ and the amount of the oxidizing agent to be supplied per one core particle are decreased (hence, the particle growth rate is decreased), and hence the optimum predetermined time is increased. It is important to determine the predetermined time in consideration of the factors described above.

When an ultrasonic wave is applied to the reaction solution the time period during which a covering composed of fine particles can be obtained becomes short because the growth rate of ferrite particles is increased, and hence it is preferable that a significantly strong ultrasonic wave be not applied.

Next, a method for forming an image using the toner of the present invention will be described.

An unfixed toner image is formed on a recording medium using the toner of the present invention and is then fixed on the recording medium by using a high-frequency magnetic field, so that an image can be formed.

A method for forming an unfixed toner image is not particularly limited, and as a means used in this method, any type of device may be used.

Example of the means for forming an unfixed toner image on a recording medium includes a conventionally known device used for an electrophotographic type copying machine, laser printer, and the like, that is, a device having a photoreceptor, a charging means for imparting electrical charge to the photoreceptor, an exposure means for irradiating an electrically-charged region of the photoreceptor with light to form an electrostatic latent image, a developing means for developing the electrostatic latent image using a toner to form a toner image, and a transferring means for transferring the toner image to a recording medium.

In this case, as the photoreceptor, charging means, exposure means, developing means, and transferring means, any device generally used may be used.

In order to fix the unfixed toner image, a high-frequency magnetic field is generated by a fixing means and noncontact high-frequency magnetic induction is performed under this magnetic field in superparamagnetic fine particles which adhere to surfaces of toner particles to generate relaxation heat by Neel relaxation and/or Brown relaxation, and then the toner particles (core particles) are melted by this heat, so that the unfixed toner image is melt-fixed on a recording medium.

The fixing means generates a high-frequency magnetic field over a region which can cover a part or the entire of the unfixed toner image to be fixed. As a result, the superparamagnetic fine particles adhering to the surfaces of the toner particles are heated by Neel relaxation and/or Brown relaxation, so that the toner is melted.

The fixing means has a magnetic field generator. As the magnetic field generator, for example, a high-frequency excitation coil may be used. In the high-frequency excitation coil, a high-frequency magnetic field is generated by applying an alternating current to the coil. The coil may be a coil composed of a conductive coil material, and a coil used in a general induction heating device may be used. In addition, as the frequency of an alternating current applied in the coil, any frequency which induces Neel relaxation and/or Brown relaxation in superparamagnetic fine particles adhering to the surfaces of the toner particles may be used, and the frequency may be appropriately determined in accordance with the composition, particle diameter, and the like of the superparamagnetic fine particles. The frequency as described above is generally higher than the frequency used in a high-frequency magnetic induction system using eddy current losses and/or hysteresis losses. In general, the frequency described above is approximately 20 kHz to 10 MHz and may be in the range of 100 kHz to 5 MHz or in the range of 300 KHz to less than 1 MHz. In some embodiments, the frequency of the high-frequency magnetic field is in the range of from 300 kHz to 1 MHz.

In addition, one large high-frequency excitation coil may be used as the magnetic field generator, or multiple high-frequency excitation coils may be disposed in a lateral direction and/or a longitudinal direction to form the magnetic field generator. Examples of the magnetic field generator described above include: a Helmholtz coil having 2 concentric coils that are disposed facing each other in order to form a uniform magnetic field in a specific area therebetween; and a Merit coil having 4 coils that are disposed on the same axis with a predetermined distance ratio in order to form a uniform magnetic field.

In order to sufficiently prevent the toner from scattering in fixing, magnetic forces acting on individual toner particles under a magnetic field are preferably balanced with each other. Hence, a magnetic field generated in fixing preferably has a uniform magnetic flux density regardless of the position of the magnetic field. Accordingly, when the magnetic field generation component is formed by disposing a plurality of high-frequency excitation coils, the high-frequency excitation coils may be disposed in parallel to each other with regular intervals.

Furthermore, in order to generate a magnetic field with a uniform magnetic flux density, currents flowing through coils disposed in a three-dimensional manner may be appropriately allocated so that the magnetic flux density of the magnetic field generated in a predetermined region become uniform.

The magnetic field generator may be disposed only one of the upper and the lower sides of the surface of a recording medium carrying an unfixed toner image or may be disposed at each of the two sides of the recording medium.

A fixing time, that is, a time for generating a magnetic field by turning on the fixing means, may be appropriately determined in accordance with the frequency of the magnetic field, the type of thermoplastic polymer material forming the core particles, the particle diameter of the core particles, the composition and particle diameter of the superparamagnetic fine particles, the type and surface characteristics of the recording medium, the image density, and the like. In general, the fixing time is approximately 0.1 to 10 seconds.

In addition, in order to strongly fix a toner image on a recording medium, a magnetic field may be applied while pressurizing the recording medium having an unfixed toner image between pressure members having permeability with respect to magnetic force to apply a pressure to the recording medium. Alternatively, fixing may be performed by melting a binder resin with relaxation heat generated by the application of a high frequency magnetic field while suctioning the toner image by applying a direct-current magnetic field from the opposite side on which the toner is fixed.

After the unfixed toner image is fixed on the recording medium as described above, the recording medium can be cooled if desired, and an image made of the toner fixed on the recording medium can be obtained.

Hereinafter, with reference to the drawings, an image forming apparatus using a toner manufactured by the manufacturing method of the present invention and a method for forming an image will be described.

Figure 2:
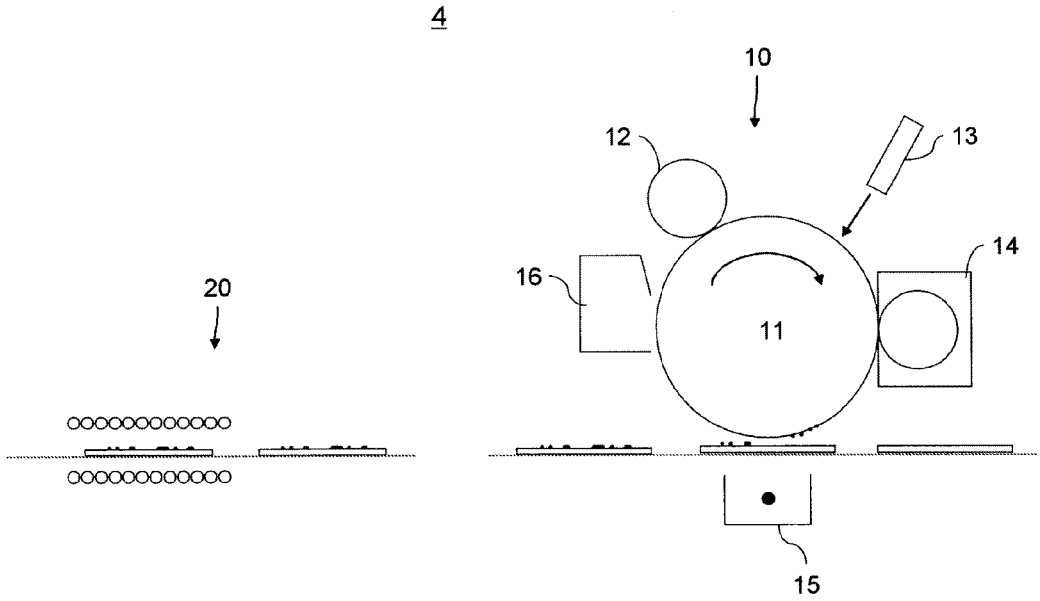
FIG. 2 is a schematic view showing one example of an image forming apparatus in which image formation is performed using the toner of the present invention.

FIG. 2 is a schematic view showing a particular example of an image forming apparatus.

An image forming apparatus 4 has a means 10 for forming an unfixed toner image on a recording medium and a fixing means 20 for fixing the unfixed toner image on the recording medium.

The means 10 for forming an unfixed toner image has a photosensitive drum 11, a charging means 12 for imparting electrical charge to the surface of this photosensitive drum to have a predetermined potential, an exposure means 13 for exposing the drum to form an electrostatic latent image on the surface thereof, a development means 14 for developing the electrostatic latent image with a toner to form a visualized toner image, and a transferring means 15 for transferring the toner image to a recording medium such as paper from the photosensitive drum. Furthermore, in order to use the photosensitive drum for the following image formation, the means 10 for forming an unfixed toner image also has a cleaning means 16 for removing a toner remaining on the surface of the drum.

Figure 3:
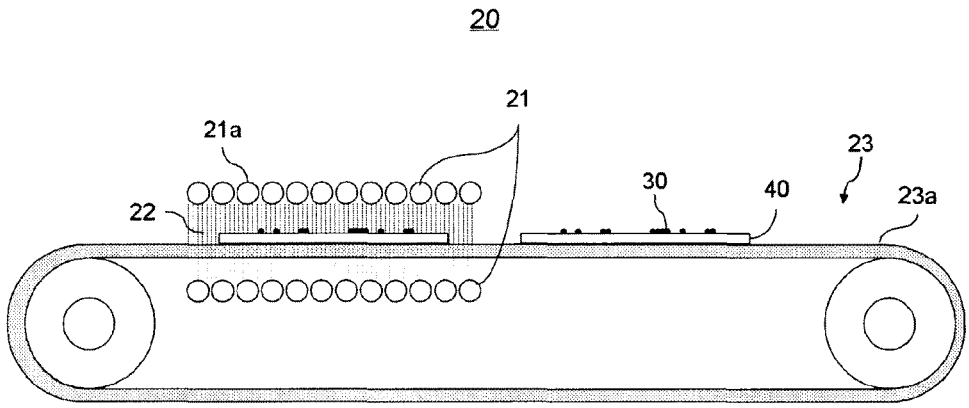
FIG. 3 is a schematic view showing one example of a fixing means of the image forming apparatus shown in FIG. 2.

As shown in FIG. 3, the fixing means 20 has magnetic field generator 21 in which high-frequency excitation coils 21*a* are disposed in parallel to each other, and a transporting means 23 for transporting a recording medium 40 carrying an unfixed toner 30 to a region 22 in which a magnetic field is generated by the high-frequency magnetic field generation components 21. In this particular example, the magnetic generator 21 are disposed at an upper side and a lower side of a transport belt 23*a* of the transporting component 23.

Next, the operation of the fixing means 20 will be described.

The recording medium 40 carrying the unfixed toner image formed by the means for forming an unfixed toner image is transported by the transporting means 23 into the region 22 in which a magnetic field is to be generated, and next, an alternating electrical current is applied to the excitation coils 21*a*, so that a magnetic field is generated. By the function of the magnetic field, Neel relaxation and/or Brown relaxation occurs in the superparamagnetic fine particles (not shown) adhering to the surface of the unfixed toner 30 to generate relaxation heat, and by this heat, the thermoplastic polymer material (not shown) forming the core particles of the unfixed toner 30 is melted, so that the toner is melt-fixed on the recording medium 40.

After a predetermined fixing time has elapsed, the application of a high-frequency magnetic field is stopped so that the recording medium 40 on which the toner image is fixed is discharged to a copy receiving tray (not shown) by the transport component 23, and at the same time, a new recording medium 40 to be processed by fixing is transported and disposed in the region 22.

EXAMPLES

Hereinafter, an example of a method for manufacturing core particles having ferrite fine particles on the surfaces thereof by a ferrite plating method will be described, the example being used in the method for manufacturing a toner according to the present invention.

Manufacturing Example 1

A reaction solution containing $FeCl_2$ as a $Fe^{2+}$ source at a concentration of 10 mmol/liter and $CH_3COONa$ as a pH buffer at a concentration of 10 mmol/liter was prepared in a conical flask having a volume of 500 ml, and an aqueous dispersion in which polyacrylate particles having a diameter of 5 μm were dispersed was added to the above reaction solution so that the concentration of the particles was 0.08 percent by weight. Furthermore, after $NaNO_3$ at a concentration of 250 mmol/liter was added as an oxidizing agent, ferrite plating was performed at 60° C. for 30 minutes while stirring. The steps described above were all performed while bubbling $N_2$ into the reaction solution. After the plating was completed, the reaction solution was rapidly cooled to room temperature, the particles were then recovered using a magnet, and dried.

Subsequently, the particles thus obtained were observed with a field-emission transmission electron microscope (FE-SEM). Fine particles having a particle diameter of 20±5 nm were formed, as islands, on the surface of each polyacrylate particle. The observation with a powder x-ray diffraction apparatus indicated that the fine particles which were formed as islands were ferrite fine particles having a magnetite structure.

When plating was performed for 90 minutes or more under the same conditions as described above, the fine particles having an island structure were converted into a continuous ferrite covering.

Manufacturing Example 2

Figure 4:
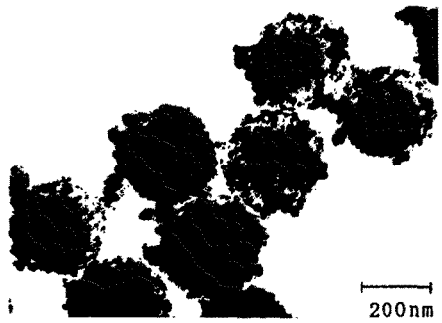
FIG. 4 is a photograph of core particles obtained in a manufacturing example 2, with ferrite fine particles formed on the surfaces of such core particles.

An aqueous dispersion in which polyacrylate particles having a diameter of 0.25 μm were dispersed in water containing $CH_3COOH$ as a pH buffer was prepared in a reaction container having a volume of 1 liter and was maintained at 70° C. Subsequently, after an aqueous solution containing $FeCl_2$ and $NaNO_2$ as an oxidizing agent was added to the above aqueous dispersion, a NaOH aqueous solution as a pH adjusting solution was further added to maintain the pH at 11, and ferrite plating was performed while stirring at 70° C. After the plating was finished, the polyacrylate particles were separated from the reaction solution, and washing was performed several times using deionized water, followed by drying. Subsequently, when observation was performed using a transmission electron microscope (SEM), fine particles as islands were confirmed on the surface of each polyacrylate particle. The photograph of the fine particles is shown in FIG. 4.

Although the examples of the present invention have thus been described, the present invention is not limited to the configurations shown in the examples, and additions and modifications may be made without departing from the spirit and scope of the present invention.

INDUSTRIAL APPLICABILITY

The toner manufactured by the manufacturing method according to the present invention may be used for an image forming apparatus or an image forming method, such as an electrophotographic type copying machine, a laser printer, or a facsimile.

Among those mentioned above, the toner manufactured by the manufacturing method according to the present invention is suitably used in an image forming apparatus using an image forming method in which non-contact fixing is performed by high-frequency magnetic induction heating.

EXPLANATION OF THE SYMBOLS

1 toner particle
2 core particle
3 superparamagnetic particle
4 image forming apparatus
10 means for fixing an unfixed toner image
11 photosensitive drum
12 charging means
13 exposure means
14 developing means
15 transferring means
16 cleaning means
20 fixing means
21 magnetic field generator
21*a* high-frequency excitation coils
22 region in which a magnetic field is generated
23 transporting means
23*a* transport belt
30 unfixed toner
40 recording medium

What is claimed is:

1. A method for manufacturing a toner to be fixed by high-frequency magnetic induction heating which comprise at least a core particle comprising a thermoplastic polymer material; and superparamagnetic ferrite fine particles having a particle diameter of less than 100 nm which adhere to the surfaces of the core particle, the method comprising:

preparing a core particle dispersion in which a core particle comprising a thermoplastic polymer material is dispersed in a dispersion medium;

introducing divalent iron ions ($Fe^{2+}$) to the core particle dispersion;

introducing an oxidizing agent to the core particle dispersion in the presence of water; and stopping the growth of ferrite on the surface of the core particle after a predetermined time has elapsed from the introduction of the oxidizing agent;

wherein the superparamagnetic ferrite fine particles are not in contact with each other.

2. The method for manufacturing a toner according to claim 1, wherein the particle diameter of the superparamagnetic ferrite fine particles having a particle diameter of less than 100 nm is 30 nm or less.

3. The method for manufacturing a toner according to claim 1, wherein the particle diameter of the superparamagnetic ferrite fine particles having a particle diameter of less than 100 nm is in the range of from 18 to 23 nm.

4. A toner to be fixed by high-frequency magnetic induction heating comprising:

a core particle comprising a thermoplastic polymer material; and superparamagnetic fine particles having a particle diameter of less than 100 nm which adhere to the surface of the core particle, wherein the superparamagnetic fine particles are not in contact with each other.

5. The toner according to claim 4, wherein the particle diameter of the superparamagnetic fine particles having a particle diameter of less than 100 nm is 30 nm or less.

6. The toner according to claim 4, wherein the particle diameter of the superparamagnetic fine particles is in the range of 18 to 23 nm.

7. The toner according to claim 4, wherein the thermoplastic polymer material comprises polyacrylate, polystyrene, styrene copolymer, or polyester.

8. The toner according to claim 7, wherein the styrene copolymer is styrene-butadiene copolymer or styrene-(meth) acrylic acid ester copolymer.

9. The toner according to claim 4, wherein the core particle comprises wax or an antistatic agent.

10. The toner according to claim 4, wherein the core particle comprises an organic coloring agent or an inorganic coloring agent.

11. The toner according to claim 4, wherein the superparamagnetic fine particles comprise magnetite, maghemite, Co ferrite, or hexagonal barium ferrite.

12. A toner to be fixed by high-frequency magnetic induction heating comprising:

a core particle comprising a thermoplastic polymer material; and superparamagnetic fine particles having a from 18 to 23 nm which adhere to the surface of the core particle.

13. A method for forming an image comprising:

forming an unfixed toner image on a recording medium; and fixing the unfixed toner image on the recording medium by using a high-frequency magnetic field, wherein, the toner comprises:

a core particle comprising a thermoplastic polymer material; and superparamagnetic fine particles having a particle diameter of less than 100 nm which adhere to the surface of the core particle, wherein the superparamagnetic fine particles are not in contact with each other.

14. The method for forming an image according to claim 13, wherein the frequency of the high-frequency magnetic field is in the range of from 100 kHz to 5 MHz.

15. The method for forming an image according to claim 13, wherein the frequency of the high-frequency magnetic field is in the range of from 300 kHz to 1 MHz.

16. A method for forming an image comprising:

forming an unfixed toner image on a recording medium; and fixing the unfixed toner image on the recording medium by using a high-frequency magnetic field, wherein the toner comprises:

a core particle comprising a thermoplastic polymer material; and superparamagnetic fine particles having a particle diameter from 18 to 23 nm, and which adhere to the surface of the core particle.

17. The method for forming an image according to claim 16, wherein the frequency of the high-frequency magnetic field is in the range of from 100 kHz to 5 MHz.

18. The method for forming an image according to claim 16, wherein the frequency of the high-frequency magnetic field is in the range of from 300 kHz to 1 MHz.

19. A method for manufacturing a toner to be fixed by high-frequency magnetic induction heating which comprise at least a core particle comprising a thermoplastic polymer material; and superparamagnetic ferrite fine particles having a particle diameter of from 18 to 23 nm which adhere to the surfaces of the core particle, the method comprising:

preparing a core particle dispersion in which a core particle comprising a thermoplastic polymer material is dispersed in a dispersion medium;

introducing divalent iron ions ($Fe^{2+}$) to the core particle dispersion;

introducing an oxidizing agent to the core particle dispersion in the presence of water; and stopping the growth of ferrite on the surface of the core particle after a predetermined time has elapsed from the introduction of the oxidizing agent.

* * * * *

UNITED STATES PATENT AND TRADEMARK OFFICE

CERTIFICATE OF CORRECTION

PATENT NO. : 8,057,976 B2
APPLICATION NO. : 12/544839
DATED : November 15, 2011
INVENTOR(S) : Ueda et al.

It is certified that error appears in the above-identified patent and that said Letters Patent is hereby corrected as shown below:

In Column 2, Line 22, delete "filed," and insert -- field, --, therefor.

In Column 9, Line 5, delete "$Mn^{2+}$" and insert -- $Mn^{2+}$, --, therefor.

In Column 14, Line 49, in Claim 6, delete "of" and insert -- of from --, therefor.

In Column 15, Line 1, in Claim 12, delete "having a" and insert -- having a particle diameter of --, therefor.

Signed and Sealed this
Eighth Day of May, 2012

David J. Kappos

David J. Kappos
*Director of the United States Patent and Trademark Office*